United States Patent [19]

Fox et al.

[11] Patent Number: 4,472,595

[45] Date of Patent: Sep. 18, 1984

[54] COAXIAL CABLE HAVING ENHANCED HANDLING AND BENDING CHARACTERISTICS

[75] Inventors: Steve A. Fox, Hickory; Larry W. Nelson, Conover; Dave W. Neville, Hickory, all of N.C.

[73] Assignee: Comm/Scope Company, Catawba, N.C.

[21] Appl. No.: 399,347

[22] Filed: Jul. 19, 1982

[51] Int. Cl.[3] ..... H01B 11/18

[52] U.S. Cl. ..... 174/36; 174/102 R; 174/107

[58] Field of Search ..... 174/102 R, 107, 36

[56] References Cited

U.S. PATENT DOCUMENTS

| | | | |
|---|---|---|---|
| 3,233,036 | 2/1966 | Jachimowicz | 174/107 |
| 3,315,025 | 4/1967 | Tomlinson | 174/28 |
| 3,529,340 | 9/1970 | Polizzano et al. | 174/102 R |
| 3,639,674 | 2/1972 | Stier | 174/36 |
| 3,662,090 | 5/1972 | Grey | 174/102 R X |
| 3,681,515 | 8/1972 | Mildner | 174/102 D X |
| 3,795,540 | 3/1974 | Mildner | 174/105 B X |
| 3,927,247 | 12/1975 | Timmons | 174/107 X |
| 3,971,879 | 7/1976 | Rosenberg et al. | 174/36 |
| 4,104,481 | 8/1978 | Wilkenloh et al. | 174/28 |
| 4,327,248 | 4/1982 | Campbell | 174/102 R X |

FOREIGN PATENT DOCUMENTS

| | | |
|---|---|---|
| 2628946 | 12/1977 | Fed. Rep. of Germany . |
| 472100 | 4/1969 | Sweden . |
| 1222076 | 4/1969 | United Kingdom . |

*Primary Examiner*—G. P. Tolin
*Assistant Examiner*—Morris H. Nimmo
*Attorney, Agent, or Firm*—Bell, Seltzer, Park & Gibson

[57] ABSTRACT

Significantly enhanced bending characteristics are provided in a coaxial cable by reducing the stiffness of the tubular sheath in relation to the stiffness of the core. The cable comprises a core including at least one inner conductor and a low loss dielectric surrounding the inner conductor, and an electrically and mechanically continuous tubular metallic sheath closely surrounding the core and being adhesively bonded thereto, the ratio of the stiffness of the core to the stiffness of the tubular sheath being greater than 5.

16 Claims, 3 Drawing Figures

COAXIAL CABLE HAVING ENHANCED HANDLING AND BENDING CHARACTERISTICS

FIELD OF THE INVENTION

This invention relates to a coaxial cable, and more particularly to an improved low-loss coaxial cable having greatly enhanced bending and handling characteristics and improved attenuation properties for a given nominal size.

BACKGROUND OF THE INVENTION

The coaxial cables commonly used today for transmission of RF signals, such as television signals for example, comprise a core containing an inner conductor and dielectric, and a metallic sheath surrounding the core and serving as an outer conductor. The dielectric surrounds the inner conductor and electrically insulates it from the surrounding metallic sheath. In some types of coaxial cables, air is used as the dielectric material, and electrically insulating spacers are provided at spaced locations throughout the length of the cable for holding the inner conductor coaxially within the surrounding sheath. In other known coaxial cable constructions, an expanded foam dielectric material surrounds the inner conductor and fills the space between the inner conductor and the surrounding metallic sheath.

In order to provide flexibility, some of the coaxial cables of the prior art have used a flexible metallic braid or a thin overlapping flexible metallic foil wrap as the sheath or outer conductor, as disclosed for example in U.S. Pat. Nos. 3,032,604; 3,315,025; 3,662,090 and 3,727,247. However, a disadvantage of this type of overlapping construction is that the discontinuous outer conductor or sheath does not totally shield the cable electrically and the sheath also permits moisture or other contaminants to enter the cable. These conditions of electrical field radiation and moisture ingress are further aggravated by flexure.

A very important function of the metallic sheath in a coaxial cable is to electrically shield the cable from external fields which might interfere with the electrical signal being carried by the cable and also to prevent leakage of the RF signal from the cable. Another important function of the sheath is to seal the cable against the permeation of moisture, which adversely affects the insulating properties of the dielectric and permits corrosion of the inner conductor. Consequently, the metallic sheath used in the majority of the prior coaxial cables is formed from a continuous tube of non-overlapping electrically conductive metal, such as aluminum. Particular efforts have been made in the production of these coaxial cables to ensure that the tube which forms the metallic sheath be both mechanically and electrically continuous. By "mechanically continuous," it is meant that the outer conductor is continuous in both its longitudinal and circumferential extent and mechanically seals the cable against ingress of contaminants such as moisture. This can be measured by measurement of its uniformity of physical properties. By "electrically continuous," it is meant that the outer conductor or sheath is electrically conductive throughout its longitudinal and circumferential extent and seals the cable against leakage of RF radiation either in or out. This can be measured by measurement of the uniformity of electric and magnetic fields external to the cable. In the coaxial cables of known construction, tubular metallic sheaths of a mechanically and electrically continuous construction are produced by various methods, such as by forming a metallic strip or tape longitudinally into a tubular configuration and welding the same, or by extrusion of a seamless metal tube of finite length.

While cables having an electrically and mechanically continuous tubular sheath provide better protection against outside environmental and electrical influences than the prior cable designs noted earlier which use metallic braids and/or foils, the continuous tubular sheath gives the cable significantly less flexibility, and thus makes handling and installation of the cables more difficult. Some improvement in bending properties can be achieved by corrugating the sheath, but the improvement in performance marginally justifies the expense. The cost of the cable is increased and the corrugations reduce the effective electrical diameter and thus adversely affect attenuation.

One of the design criteria which must be considered in producing any coaxial cable is that the cable must have sufficient compressive strength to permit bending and to withstand the general abuse encountered during normal handling and installation. For example, installation of the coaxial cable generally requires passing the cable around one or more rollers as the cable is strung on utility poles. Any buckling, flattening or collapsing of the tubular metallic sheath which might occur during such installation has serious adverse consequences on the electrical characteristics of the cable, and may even render the cable unusable. Such buckling, flattening or collapsing also destroys the mechanical integrity of the cable and introduces the possibility of leakage or contamination.

Bending or buckling of the sheath is particularly troublesome for coaxial cables of the air dielectric type, which, due to the use of spaced discs or spacers, do not exhibit uniform compressive stiffness along their length. These cables are highly susceptible to bending midway between adjacent spacers where the tube is unsupported and the ratio of core stiffness to tube stiffness is at a minimum. However, this problem is no less serious in coaxial cables of the type which use a foam dielectric.

In order to provide adequate compressive strength to withstand the abuse encountered during installation and to prevent buckling, one approach which has been taken in the design of the prior coaxial cables has been to increase the compressive strength of the continuous tubular sheath by providing a relatively heavy wall thickness, typically greater than about 0.025 inches and ranging upwards of 0.055 inches for one inch diameter cables. However, significant loss of flexibility results. Other methods to improve flexibility involve the addition of dielectric, either by placing larger numbers of spacers or by increasing the density of the foam dielectric. This does provide improvement in flexibility, but always at the expense of increased attenuation.

SUMMARY OF THE INVENTION

With the foregoing in mind, it is an important object of the present invention to achieve greatly enhanced bending characteristics in a coaxial cable of the type having an electrically and mechanically continuous non-overlapping metallic sheath.

A further object is to provide this improvement in flexibility while also maintaining low attenuation characteristics.

In achieving these objects, and in attaining greatly enhanced bending characteristics in the coaxial cables of this invention, we have departed from the traditional approaches noted above which have been used in the design of prior coaxial cables with a continuous tubular sheath.

The present invention is based on the recognition that greatly enhanced bending characteristics are achieved by reducing the stiffness of the tubular sheath in relation to the stiffness of the core such that the core serves a much greater role in contributing to the cable physical strength properties. Preferably, the ratio of the core stiffness to the stiffness of the sheath should be greater than 5. Most desirably, the core to sheath stiffness ratio should be 10 or greater. For purposes of comparison, typical core to sheath stiffness ratios for commercially available prior art coaxial cables are in the range of about 0.5 to less than 3 as will be seen from the data presented in the detailed description which follows.

Reduction in stiffness of the tubular sheath is achieved by reducing its wall thickness in relation to its diameter. The tubular sheath outer diameter is generally 0.4 inch or greater. Preferably, the reduction in the tubular sheath wall thickness is such that the ratio of the wall thickness to its outer diameter (T/D ratio) is no greater than about 2.5 percent.

Coaxial cables in accordance with the broad aspects of the present invention employ the above relationships in a construction which comprises a core including at least one inner conductor and a low loss dielectric surrounding the inner conductor, and an electrically and mechanically continuous tubular metallic sheath (as earlier defined) closely surrounding the core and being adhesively bonded thereto.

While adhesives have been previously used in the construction of coaxial cables, the primary purpose of the adhesive has been to exclude the migration of water or water vapor at the interface between the core and the sheath. In practice, adhesives have been used almost exclusively in constructions where the sheath is not mechanically continuous, such as where a thin metallic foil is used to form the sheath, and the purpose of the adhesives in this instance is to hold the assembly together and to exclude contaminants such as water, or in corrugated designs to prevent moisture migration. Adhesives have not generally been utilized in coaxial cables with a continuous sheath because of the difficulty of applying the adhesive in this type construction and because the benefits provided thereby have been overwhelmingly offset by the electrical loss imparted by the presence of the adhesive. The improved bending characteristics brought about by the present invention, however, more than offset any effects of electrical loss brought about through the use of an adhesive.

The reduction of the wall thickness of the sheath, in addition to providing greatly enhanced bending characteristics as noted above, provides a very significant reduction in materials cost as compared to the commercially available prior art coaxial cables, where the thicker walled continuous outer sheath may typically comprise as much as half the cost of the product.

An ancillary, but no less important, benefit of reducing the wall thickness of the sheath is that lower attenuation levels are achieved. In this regard, one known method of lowering attenuation in coaxial cables involves making the cable larger; however, the increase in size is limited by cost since the cost increases at a rate faster than the improvement in attenuation. When we speak of cable size, the electrical size will be established by the inside diameter of the outer conductor or sheath. By thinning the outer conductor in accordance with the present invention, it is possible to keep the outer conductor of the coaxial cable at established nominal values, and the result of the thinner outer conductor is to establish a larger electrical diameter and consequently to reduce attenuation.

To further reduce attenuation, the coaxial cables of the present invention use a low loss dielectric material in the core. As used herein the term "low loss dielectric" refers to a dielectric material which propagates electromagnetic waves at a velocity greater than 0.85 times the speed of light. Examples of low loss dielectrics include selected low specific gravity foam polyethylene and polystyrene polymers, such as are disclosed in commonly owned U.S. Pat. No. 4,104,481, and selected air dielectric constructions.

BRIEF DESCRIPTION OF THE DRAWINGS

Some of the features and advantages of the invention having been stated, others will become apparent when the description proceeds, when taken in connection with the accompanying drawings, in which—

STRUCTURAL MECHANICS OF THE IMPROVED COAXIAL CABLE DESIGN

Figure 1:
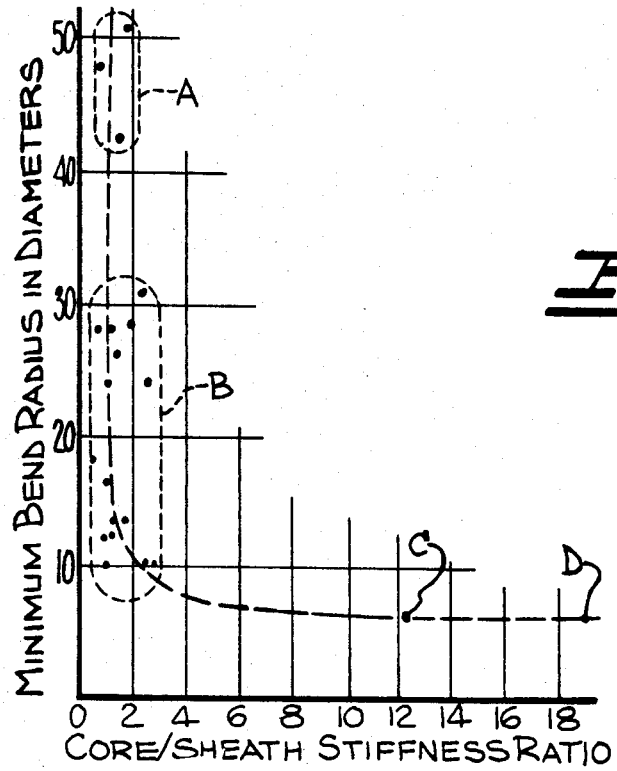
FIG. 1 is a graph illustrating the relationship of core to sheath stiffness to the bending characteristics of a coaxial cable and comparing the present invention with commercially available prior art continuous sheath coaxial cables.

It is believed that the following theoretical discussion will be helpful to an understanding of the present invention, how the improved bending characteristics disclosed herein are obtained, and how the cable design of the present invention differs from existing coaxial cables. It should be understood at the outset, however, that the purpose of this discussion is to provide a better understanding of the approach which went into the design of this cable and it is not intended that the discussion of any particular theory or mechanism be construed as limiting the present invention, the scope of the invention being defined in the appended claims which follow.

When a coaxial cable is subjected to bending until failure, i.e. buckling occurs, the point of failure will reside on the compressive side of the bend. It is at this location in the cable that the tubular sheath is in its state of maximum compressive load. For purposes of a theoretical model, the tubular outer conductor may be viewed as a series of parallel fibers arranged side-by-side in a circular pattern to form the cylindrical configuration of the tube. At the point of maximum compressive load, the individual "fiber" may be modeled by a column in compression, with some defined degree of eccentricity. It is known from principles of engineering mechanics that as the bend radius (or eccentricity) becomes more exaggerated, a point will be reached where the fiber will go into yield. Loads will concentrate at that point to provide an equilibrium of stress, and buckling occurs in the fiber. Obviously, for a thin walled tube, the description of the mechanics is much more complex to relate.

By establishing a composite where each fiber of the tubular outer conductor is in intimate contact with or bonded to a second material of greater flexural stiffness and elongational capability, the point at which buckling occurs can be extended. In the coaxial cable design of the present invention, the second component of greater stiffness and elongational capability is the dielectric insulation and/or outer protective jacket.

Consider the more accurate model of the fiber (as above) but wherein the fiber is now bonded to a second material of considerably greater thickness and the centroid or neutral axis in bending is external to the first material (outer conductor) and well into the second material (the dielectric). Uniquely, because of disparity in both elastic modulus and thickness (area moment of inertia in bending) of the two materials, the resulting composite derives almost the entirety of its axial stiffness from the outer conductor and the entirety of the flexural stiffness from the dielectric. Likewise, examination of the composite fiber from its side in point compressive loading would show nearly the entirety of compressive stiffness attributable to the dielectric. Now as the composite fiber is bent to a small radius, the outer conductor's stress which would otherwise put it into a buckling mode is supported by the stiffer dielectric.

Therefore, to assure that this relationship can be maximized, it is desirous to maximize the stiffness of the low loss dielectric in relation to the stiffness of the outer conductor. Reduction of outer conductor stiffness is accomplished by lowering its temper and reducing its cross-sectional area (wall thickness).

The impact of this analysis is related by the empirical data shown in Table 1, and as graphically presented in FIG. 1.

elements of this simplified representation do apply in the plastic regions of deformation. Stated in other terms, even though the bending of the coaxial cable plastically deforms the outer conductor, the lower the temper, the lower the inward normal force applied by the tube.

As bending continues to be exaggerated, there is a point at which the dielectric and the outer conductor disassociate and no longer perform as a composite. This condition will otherwise limit the extent of bending. By applying an adhesive between the dielectric and the outer sheath, the point at which this disassociation occurs is extended and the bending radius can thus be substantially lowered. This is shown in part in Table 1 and in FIG. 1.

FIG. 1 compares the bending properties of a number of commercially available continuous sheath coaxial cables and the coaxial cable of the present invention as a function of the core to sheath stiffness ratio. The bending properties are expressed as the bend radius in cable diameters. The minimum bend radius is determined by progressively bending the cable over smaller and smaller mandrels of uniform radius. After each bend, the cable is examined for any signs of waviness or buckling. The smallest radius mandrel in which the first signs of waviness occur is defined as the minimum bend radius.

The core to sheath stiffness ratio is determined by independently evaluating the compressive stiffness of the core (inner conductor and dielectric) and the outer conductor as would be observed from its side. A sample of core or outer conductor of fixed length (1 inch) is placed in a compressive load fixture (universal tester) and deflected a defined amount. For both the core and outer conductor, this deflection was defined as 12% of its respective diameter. The ratio of stiffness is then expressed as the ratio of the recorded loads at the defined deflection.

TABLE 1

| | Cable Outer Diameter (inches) | Core Stiffness* | Sheath Stiffness* | Core/Sheath Stiffness Ratio | Minimum Bend Diameter (in inches) | Minimum Bend Radius (in diameters) |
|---|---|---|---|---|---|---|
| Comparative Commercially Available Coaxial Cables | | | | | | |
| 1 | 1.000 | 110.5 | 84.0 | 1.3 | 26.0 | 26.0 |
| 2 | .875 | 106.0 | 54.0 | 1.9 | 24.0 | 27.4 |
| 3 | .750 | 87.5 | 52.0 | 1.6 | 18.0 | 24.0 |
| 4 | .625 | 62.0 | 48.5 | 1.3 | 8.25 | 13.2 |
| 5 | .500 | 46.0 | 38.0 | 1.2 | 8.25 | 16.5 |
| 6** | .412 | 26.75 | 57.5 | 0.47 | 7.5 | 18.2 |
| 7 | .750 | 131.0 | 50.5 | 2.6 | 7.5 | 10.0 |
| 8 | .500 | 86.8 | 40.0 | 2.8 | 5.0 | 10.0 |
| 9 | .412 | 74.1 | 56.5 | 1.3 | 5.0 | 12.1 |
| 10 | .750 | 37.0 | 52.0 | 0.71 | 21.0 | 28.0 |
| 11 | .875 | 122.5 | 54.0 | 2.2 | 27.0 | 30.8 |
| 12 | .625 | 57.0 | 54.0 | 1.05 | 7.25 | 12.0 |
| 13 | .500 | 43.0 | 38.5 | 1.12 | 5.0 | 10.0 |
| 14 | .875 | 142.0 | 54.0 | 2.6 | 21.0 | 24.0 |
| 15 | .625 | 90.75 | 51.5 | 1.7 | 8.25 | 13.2 |
| 16 | .750 | 91.25 | 65.0 | 1.4 | 32.0 | 42.6 |
| 17 | .500 | 57.75 | 51.0 | 1.13 | 24.0 | 48.0 |
| 18 | .450 | 34.0 | 57.5 | 0.6 | 24.0 | 53.3 |
| 19 | .250 | 3.5 | 55.0 | 0.06 | 7.0 | 28.0 |
| Coaxial Cables of the Invention | | | | | | |
| 20 | .860 | 134.0 | 7.0 | 19.1 | 6.0 | 6.9 |
| 21 | .500 | 56.0 | 4.6 | 12.2 | 3.25 | 6.5 |

*at 12% deflection
**Cable specimen is described in U.S. Pat. No. 4,104,481 column 13 line 2–7

Particular note should be made that even though in elastic theory, the condition of buckling in a column or tube is, in part, a function of the yield strength, $S_y$, the Referring to FIG. 1, the points identified at A represent commercially available coaxial cables of the air dielectric type in which a series of spaced discs are utilized to hold the center conductor. It will be seen that the minimum bend radius is quite large, exceeding 40 times the cable diameter, and the ratio of core to sheath stiffness (due to the absence of any substantial stiffness of the core itself) is quite low.

The cluster of points identified at B represents commercially available foam dielectric coaxial cables with an electrically and mechanically continuous tubular sheath. It will be noted that all of these points are clustered together generally within the core to sheath stiffness ratio of about 0.5 to less than 3, and the minimum bend radius was 10 or greater.

The points identified at C and D represent cables produced in accordance with the present invention. The minimum bend radius is very significantly lower than that of any of the other commercially available continuous sheath coaxial cables, and the ratio of core to sheath stiffness is very significantly greater. The minimum bend radius was significantly less than 10, more on the order of about 7 or lower.

To provide a cable with bending characteristics significantly greater than that presently attainable by conventional constructions, it is desirable that the core to sheath stiffness ratio for cables in accordance with the present invention be at least about 5, and preferably about 10 or greater. From the theoretical curve shown in FIG. 1, it will be seen that the improvement in bending radius increases exponentially when the core to sheath stiffness ratio is increased to the levels defined for cables of the present invention.

DESCRIPTION OF ILLUSTRATED EMBODIMENT

Figure 2:
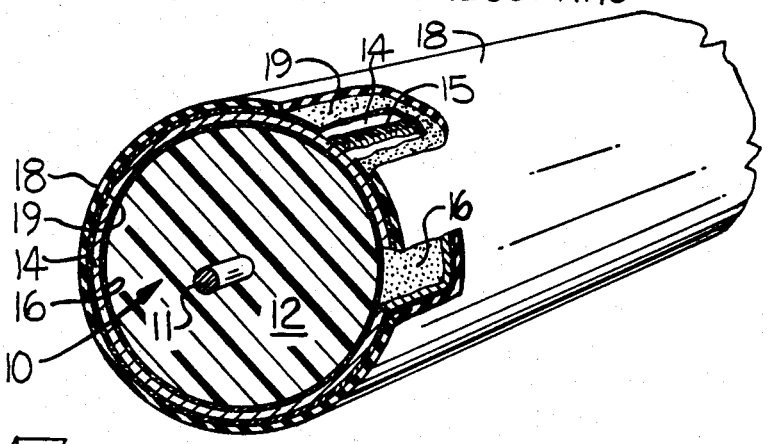
FIG. 2 is a perspective view showing a coaxial cable in accordance with the present invention in cross-section, and with portions of the cable broken away for purposes of clarity of illustration.

Referring now more particularly to the drawings, FIG. 2 illustrates a coaxial cable produced in accordance with the present invention and embodying the novel relationships of sheath to core stiffness herein disclosed. The coaxial cable illustrated comprises a core 10 which includes an inner conductor 11 of a suitable electrically conductive material such as copper, and a surrounding continuous cylindrical wall of expanded foam plastic dielectric material 12. In the embodiment illustrated, only a single inner conductor 11 is shown, as this is the arrangement most commonly used for coaxial cables of the type used for transmitting RF signals, such as television signals. However, it should be understood that the present invention is applicable also to coaxial cables having more than one inner conductor insulated from one another and forming a part of the core. The dielectric 12 is a low loss dielectric and may be formed of a suitable plastic, such as polyethylene, polystyrene, polypropylene. Preferably, in order to reduce the mass of the dielectric per unit length, and hence reduce the dielectric constant, the dielectric material should be of an expanded cellular foam composition. A particularly preferred foam dielectric is expanded high density polyethylene polymer such as is described in commonly owned U.S. Pat. No. 4,104,481, issued Aug. 1, 1978.

Closely surrounding the core is a continuous tubular metallic sheath 14. The sheath 14 is characterized by being both electrically and mechanically continuous (as earlier defined) so as to effectively serve to mechanically and electrically seal the cable against outside influences, as well as to seal the cable against leakage of RF radiation. The tubular metallic sheath 14 may be formed of various electrically conductive metals, such as copper or aluminum. Aluminum is preferred for reasons of cost. The tubular aluminum sheath 14 has a wall thickness selected so as to maintain a T/D ratio of less than 2.5 percent. For the cable illustrated, the wall thickness is less than 0.020 inch. To provide the desired relatively low stiffness characteristics, the tubular sheath is preferably formed from aluminum which is in a fully annealed condition, typically referred to as "O" temper aluminum.

In the preferred embodiment illustrated, the continuous tubular aluminum sheath 14 is formed from a thin flat strip of "O" temper aluminum which is formed into a tubular configuration with the opposing side edges of the aluminum strip butted together, and with the butted edges continuously joined by a continuous longitudinal weld, indicated at 15. While production of the sheath 14 by longitudinal welding has been illustrated as preferred, persons skilled in the art will recognize that other methods for producing a mechanically and electrically continuous thin walled tubular metal sheath could be employed if desired.

The inner surface of the tubular sheath 14 is continuously bonded throughout its length and throughout its circumferential extent to the outer surface of the dielectric 12 of the core by the use of a thin layer of adhesive 16. A preferred class of adhesive for this purpose is a random copolymer of ethylene and acrylic acid. Such adhesives have been previously used in coaxial cable construction, and are described for example in prior U.S. Pat. Nos. 2,970,129; 3,520,861; 3,681,515; and 3,795,540.

The layer of adhesive 16 should be made as thin as possible so as to avoid adversely affecting the electrical characteristics of a cable. Desirably, the layer of adhesive 16 should have a thickness of about 1 mil or less. The presently preferred method of obtaining such a thin deposit of adhesive and a suitable adhesive composition therefor are disclosed in commonly owned copending application Ser. No. 399,346, of Wayne L. Gindrup filed concurrently herewith, and entitled CABLE WITH ADHESIVELY BONDED SHEATH.

Optionally, if desired to provide added protection to the cable, the outer surface of the sheath 14 may be surrounded by a protective jacket 18. Suitable compositions for the outer protective jacket 18 include thermoplastic coating materials such as polyethylene, polyvinyl chloride, polyurethane and rubbers. Where a protective jacket is used, further enhancement of bending properties can be achieved by bonding the jacket 18 to the outer surface of the tubular sheath 14. This can be accomplished by depositing a thin layer of adhesive 19, such as the EAA copolymer adhesive noted above, on the outer surface of the sheath 14 and thereafter applying the protective jacket 18 by any suitable method, such as extrusion coating.

Figure 3:
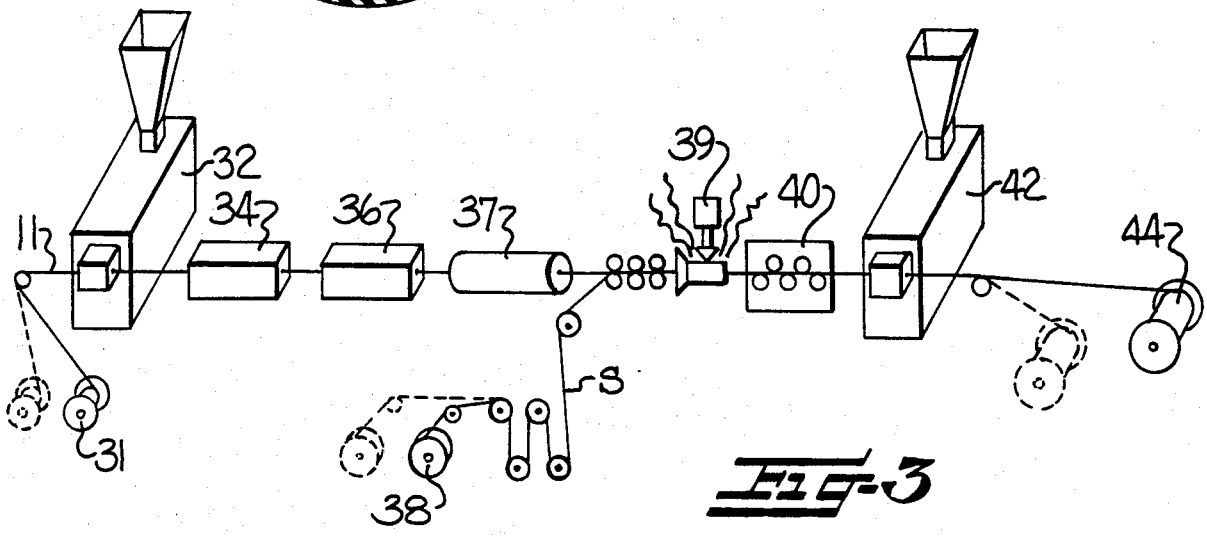
FIG. 3 is a schematic illustration of an arrangement of apparatus for producing the improved coaxial cable of this invention.

FIG. 3 illustrates a suitable arrangement of apparatus for producing the cable shown in FIG. 2. As illustrated, the center conductor 11 is directed from a suitable supply source, such as a reel 31, and is directed through an extruder apparatus 32. The extruder apparatus continuously extrudes the foamed plastic dielectric 12 concentrically around the inner conductor 11. Upon leaving the extruder, the plastic material foams and expands to form a continuous cylindrical wall of the dielectric material surrounding the center conductor. The center conductor 11 and surrounding dielectric 12 are then directed through an adhesive applying station 34 where a thin layer of an EAA adhesive composition is applied by suitable means, such as spraying or immersion. After leaving the adhesive applying station 34, excess adhesive may be removed by suitable means and the adhesive coated core 10 is directed through an adhesive drying station 36, such as a heated tunnel or chamber. Upon leaving the drying station 36, the core is directed through a cooling station 37, such as a water trough. As the core 10 advances further, a narrow strip of thin "O" temper aluminum S is directed from a suitable supply source such as reel 38 and is formed into a tubular configuration surrounding the core. The strip S of aluminum then advances through a welding apparatus 39, and the opposing side edges of the strip are positioned into butting relation and joined together by a continuous longitudinal weld. The core and surrounding sheath or jacket 14 are then passed through a rolling or stationary reduction die 40 where the tubular sheath 14 is reduced in diameter and brought into close snug relationship with the core 10. The thus produced assembly may then be directed through an optional extrusion coating apparatus 42 where a heated fluent coating material is applied to form the outer protective jacket 18. The heat of the fluent coating composition also serves to activate the thermoplastic EAA adhesive layer 16 and to thereby form a bond between the sheath 14 and the outer surface of the dielectric 12. The thus produced cable may then be collected on suitable containers, such as reels 44, suitable for storage and shipment.

In the drawings and specification there has been set forth a preferred embodiment of the invention, but it is to be understood that the invention is not limited thereto and may be embodied and practiced in other ways within the scope of the following claims.

That which is claimed is:

1. A coaxial cable comprising a core including at least one inner conductor and a low loss dielectric surrounding the inner conductor, and an electrically and mechanically continuous non-overlapping tubular metallic sheath closely surrounding said core and being adhesively bonded thereto, the ratio of the radial compressive stiffness of the core to the radial compressive stiffness of the tubular sheath being greater than 5.

2. A coaxial cable according to claim 1 wherein said electrically and mechanically continuous tubular metallic sheath comprises a smooth-walled longitudinally welded tube.

3. A coaxial cable according to claim 2 wherein said tubular metallic sheath is formed from "O" temper aluminum.

4. A coaxial cable according to claim 1 wherein said tubular metallic sheath has a thickness of no greater than about 2.5 percent of its outer diameter.

5. A coaxial cable according to claim 4 wherein the wall thickness of said tubular metallic sheath is less than 0.020 inch.

6. A coaxial cable according to claim 1 wherein the cable has a minimum bend radius significantly less than 10 cable diameters.

7. A coaxial cable according to claim 1 wherein the ratio of the stiffness of the core to the stiffness of the tubular sheath is 10 or greater.

8. A coaxial cable comprising a core including at least one inner conductor and a low loss dielectric surrounding the inner conductor, and an electrically and mechanically continuous non-overlapping tubular metallic sheath of a diameter of at least 0.4 inches closely surrounding said core and being adhesively bonded thereto to form a structural composite with said cable having a minimum bend radius significantly less than 10 cable diameters, and the ratio of the radial compressive stiffness of the core to the radial compressive stiffness of the tubular sheath being greater than 5.

9. A coaxial cable according to claim 8 wherein said electrically and mechanically continuous tubular metallic sheath comprises a smooth-walled longitudinally welded tube.

10. A coaxial cable according to claim 9 wherein the wall thickness of said longitudinally welded tube is less than 0.020 inch.

11. A coaxial cable according to claim 1 or 8 wherein said tubular metallic sheath is adhesively bonded to said core by a thin continuous adhesive layer of a thickness of about 1 mil or less.

12. A coaxial cable according to claim 1 or 8 additionally comprising a protective outer jacket surrounding the tubular metallic sheath.

13. A coaxial cable according to claim 12 including a layer of adhesive disposed between said sheath and said protective outer jacket and serving to bond the protective jacket to the outer surface of the sheath.

14. A coaxial cable having a minimum bend radius significantly less than 10 cable diameters and comprising a core including at least one inner conductor and a low loss foam dielectric surrounding the inner conductor, an electrically and mechanically continuous longitudinally welded smooth-walled non-overlapping tubular metallic sheath of a diameter of at least 0.4 inches closely surrounding said core, and a thin continuous layer of adhesive disposed between said foam dielectric and said sheath and bonding the sheath to the foam dielectric to form a structural composite, and the ratio of the radial compressive stiffness of the core to the radial compressive stiffness of the tubular sheath being greater than 5.

15. A coaxial cable comprising a core including at least one inner conductor and a foam dielectric surrounding the inner conductor, and an electrically and mechanically continuous longitudinally welded smooth-walled non-overlapping tubular aluminum sheath having a wall thickness of less than 0.020 inch and the wall thickness being no greater than about 2.5 percent of its outer diameter, said tubular aluminum sheath closely surrounding said core and having its inner surface adhesively bonded throughout to the outer surface of said foam dielectric to form a structural composite of enhanced strength and bending properties, and the ratio of the radial compressive stiffness of the core to the radial compressive stiffness of the tubular sheath being greater than 5.

16. A coaxial cable comprising a core including at least one inner conductor and a low loss foam dielectric surrounding the inner conductor, an electrically and mechanically continuous non-overlapping tubular metallic sheath closely surrounding said core, a thin continuous layer of adhesive disposed between said dielectric and said sheath and bonding the sheath to the foam dielectric, a protective outer jacket surrounding the tubular metallic sheath, and a layer of adhesive disposed between said sheath and said protective outer jacket and serving to bond the protective jacket to the outer surface of said sheath, and the ratio of the radial compressive stiffness of the core to the radial compressive stiffness of the tubular sheath being greater than 5.

* * * * *

UNITED STATES PATENT AND TRADEMARK OFFICE

CERTIFICATE OF CORRECTION

PATENT NO. : 4,472,595

DATED : September 18, 1984

INVENTOR(S) : Steve A. Fox, Larry W. Nelson, Dave W. Neville

It is certified that error appears in the above-identified patent and that said Letters Patent are hereby corrected as shown below:

Column 6, line 29, before "compressive" insert -- radial -- .

Signed and Sealed this

*Twelfth* Day of *March 1985*

[SEAL]

*Attest:*

DONALD J. QUIGG

*Attesting Officer* *Acting Commissioner of Patents and Trademarks*

US004472595B1

REEXAMINATION CERTIFICATE (2363rd)

United States Patent [19]

[11] B1 4,472,595

Fox et al.

[45] Certificate Issued Aug. 30, 1994

[54] COAXIAL CABLE HAVING ENHANCED HANDLING AND BENDING CHARACTERISTICS

[75] Inventors: Steve A. Fox, Hickory; Larry W. Nelson, Conover; Dave W. Neville, Hickory, all of N.C.

[73] Assignee: Comm/Scope Company, Catawba, N.C.

Reexamination Request:
No. 90/003,226, Oct. 21, 1993

Reexamination Certificate for:

| | |
|---|---|
| Patent No.: | **4,472,595** |
| Issued: | **Sep. 18, 1984** |
| Appl. No.: | **399,347** |
| Filed: | **Jul. 19, 1982** |

Certificate of Correction issued Mar. 12, 1985.

[51] Int. Cl.[5] ..... H01B 11/18
[52] U.S. Cl. ..... 174/36; 174/102 R; 174/107

[56] References Cited

U.S. PATENT DOCUMENTS

| | | | |
|---|---|---|---|
| 3,233,036 | 2/1966 | Jachimowicz | 174/107 |
| 3,315,025 | 4/1967 | Tomlinson | 174/28 |
| 3,529,340 | 9/1970 | Polizzano et al. | 174/102 R |
| 3,639,674 | 2/1972 | Stier | 174/36 |
| 3,662,090 | 5/1972 | Grey | 174/102 R X |
| 3,681,515 | 8/1972 | Mildner | 174/102 D X |
| 3,795,540 | 3/1974 | Mildner | 174/105 B X |
| 3,927,247 | 12/1975 | Timmons | 174/107 X |
| 3,971,879 | 7/1976 | Rosenberg et al. | 174/36 |
| 4,104,481 | 8/1978 | Wilkenloh et al. | 174/28 |
| 4,327,248 | 4/1982 | Campbell | 174/102 R X |
| 4,352,701 | 10/1982 | Shimba et al. | 156/51 |

FOREIGN PATENT DOCUMENTS

| | | |
|---|---|---|
| 2628946 | 12/1977 | Fed. Rep. of Germany . |
| 472100 | 4/1969 | Sweden . |
| 1222076 | 4/1969 | United Kingdom . |

OTHER PUBLICATIONS

Paper Entitled *Application of Welded Thin Metal In New Communication Designs* Presented at 15th Annual Wire & Cable Symposium on Dec. 7-9, 1966 and Published in Wire and Wire Products May 1967.

Paper Entitled *Electrically Welded Thin Aluminum Envelopes And Their Use In Communication Designs* Presented At 18th International Wire and Cable Symposium on Dec. 3-5, 1969 And Published in Wire and Wire Products Apr. 1970.

*Primary Examiner*—Morris H. Nimmo

[57] ABSTRACT

Significantly enhanced bending characteristics are provided in a coaxial cable by reducing the stiffness of the tubular sheath in relation to the stiffness of the core. The cable comprises a core including at least one inner conductor and a low loss dielectric surrounding the inner conductor, and an electrically and mechanically continuous tubular metallic sheath closely surrounding the core and being adhesively bonded thereto, to ratio of the stiffness of the core to the stiffness of the tubular sheath being greater than 5.

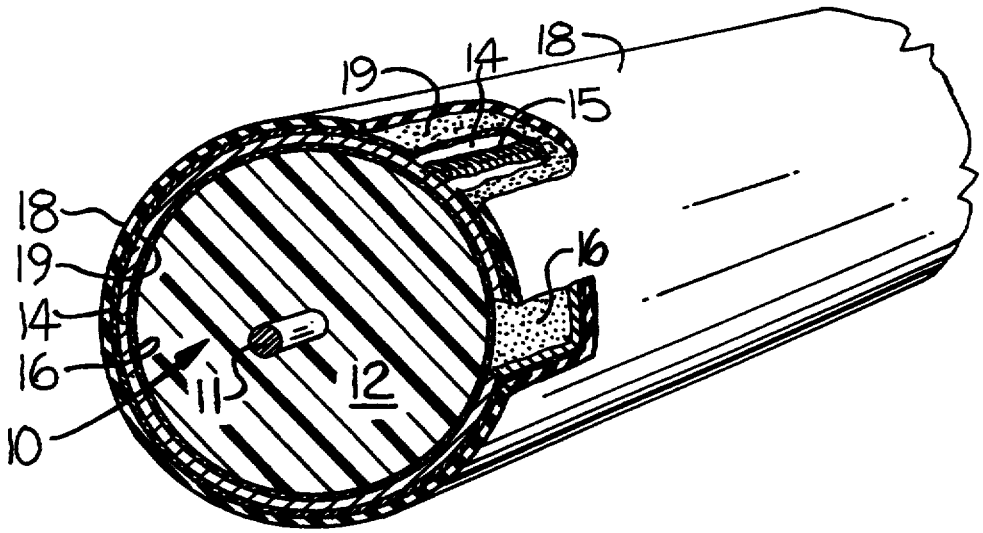

REEXAMINATION CERTIFICATE ISSUED UNDER 35 U.S.C. 307

NO AMENDMENTS HAVE BEEN MADE TO THE PATENT

AS A RESULT OF REEXAMINATION, IT HAS BEEN DETERMINED THAT:

The patentability of claims 1–16 is confirmed.

* * * * *